US005558926A

United States Patent [19]

Tate et al.

[11] Patent Number: 5,558,926

[45] Date of Patent: Sep. 24, 1996

[54] ENDLESS MULTILAYER FABRIC FOR DENSIFYING PAPER MATERIALS AND PRODUCTION PROCESS THEREOF

[75] Inventors: Takuo Tate; Nobuyoshi Takagi; Tsunekazu Kobayashi; Akinori Sano, all of Tokyo, Japan

[73] Assignee: Nippon Filcon, Co., Ltd., Tokyo, Japan

[21] Appl. No.: 551,286

[22] Filed: Oct. 31, 1995

[30] Foreign Application Priority Data

Nov. 18, 1994 [JP] Japan ..... 6-321789

[51] Int. Cl.[6] ..... B32B 23/02

[52] U.S. Cl. ..... 428/193; 427/375; 427/389.9; 427/412; 428/192; 428/246; 428/252; 428/257

[58] Field of Search ..... 428/225, 246, 428/252, 257, 267, 192, 193, 903.3; 427/375, 389.9, 412

[56] References Cited

U.S. PATENT DOCUMENTS 5,487,414 1/1996 Huji et al. ..... 428/257
5,490,543 2/1996 Fujisawa et al. ..... 428/257

*Primary Examiner*—James J. Bell
*Attorney, Agent, or Firm*—Foley & Lardner

[57] ABSTRACT

A bending resistant part of an endless multilayer fabric for densifying paper materials is placed on a trimming part; to thereby prevent cutting of a fabric at the trimming part. Also oblique movement and dropping off a guide protrusion is prevented. Particularly, a bending resistant part is formed by filling a polyurethane resin in internal structure of an endless fabric of trimming part of the width direction of the fabric woven with arranging at least three layers of weft. A guide protrusion molded from similar polyurethane is arranged on the bending resistant part by fusion. Cutting caused by bending and wearing of the fabric near the guide protrusion is prevented.

11 Claims, 6 Drawing Sheets

ENDLESS MULTILAYER FABRIC FOR DENSIFYING PAPER MATERIALS AND PRODUCTION PROCESS THEREOF

BACKGROUND OF THE INVENTION

The present invention relates to an endless multilayer fabric used for densifying paper materials, and a production process for making the fabric. In operation, the fabric removes ink particles and ash content from aqueous solutions of regenerated paper materials derived from waste papers such as newspapers obtained by deinking, deashing and other means.

Japanese Laid-Open Patent No. 2-14090/1990 is an example of a known endless fabric, in which protrusions are sewn in both ends of the width direction of fabric.

Densification of paper materials such as waste papers differs from paper manufacturing; that is, pulp materials are not uniformly deposited onto a fabric in small increment volume but are discharged under conditions where solid contents are not uniformly dispersed. Thus, in use the fabric is subjected to uneven large loads, and the rotating of endless fabric moves obliquely and sometimes is unwound from the inner roll.

For preventing such phenomena, trials have been made to provide a channel on the inner roll and to provide a guide protrusion engaging the channel in both ends of the width direction of the fabric; however, the end surface of the protrusion in the central part of the fabric cuts in a short period when the fabric runs.

Similar cutting occurs in a case where the side surface of the guide protrusion is contacted to the end surface of the inner roll for preventing the oblique movement without providing the engaging channel on the inner roll.

A known technology disclosed in Japanese Laid-Open Patent No. 2-14090/1990 mentioned above discloses the guide protrusion sewn to the fabric for preventing such cutting. By securing with sewing, the cutting of fabric is moderated to a considerable extent unlike fusion since there is free space between the protrusion and the fabric.

However, the cutting cannot be prevented perfectly and the guide performance disadvantageously deteriorates.

Japanese Laid-Open Patent No.4-361682/1992 discloses a densification endless fabric in which a guide protrusion molded in polyurethane is provided on a bending resistant part filled with polyurethane in trimming parts of an endless fabric woven by plastic monofilament.

While this net is excellent in the guide performance, the fabric has a problem of cutting in the inner end parts of the bending resistant part during use.

A fabric is, generally, woven with warp and weft and is not a rigid body; finishing treatment does not give the whole fabric uniform elongation, tensile strength and rigidity. Thus, revolution of the fabric in an endless conditions makes the fabric move from the more elongated side to the less elongated side. The crimp arrangement on the running surface of fabric makes the fabric move obliquely to one side. Furthermore, insufficient running center adjustment in a device for making the fabric rotate in an endless condition also makes the fabric move to one side.

Oblique fabric movement occurs due to various causes as explained above. The direction of oblique movement is fixed by each fabric and by the device rotating the fabric under an endless condition. If the direction of oblique movement is decided, provision of a guide protrusion in the trimming part of the opposite side is enough; however, the direction of oblique movement is ordinarily unclear until the running, and it is preferable to arrange guide protrusions on both side trimming parts. On the other hand, densification of paper materials such as waste papers is made by feeding a stream containing these onto a fabric or between a fabric and an inner roll. Dehydration is made by compression between the fabric and inner roll or by centrifugal force. Hence, if a heavy material is placed on the fabric or between the fabric and inner roll, the tension changes, and the oblique movement is accelerated. If the oblique movement is excessive, the fabric gets out of the inner roll.

When a guide protrusion is arranged in the end parts of the width direction of a fabric for guiding to engage with a channel provided in a inner roll and the channel depth is nearly equal to the guide protrusion, the inner surface of guide protrusion contacts the inner wall surface of the channel in the fabric portion that contacts the inner roll. However, the fabric tends to move more inwardly and the guide protrusion is pulled inwardly and led to go away from the channel whereby the outer side of the guide protrusion is raised and the fabric bends near the inner surface of the guide protrusion.

On the other hand, when the fabric moves outwardly against the guide protrusion, the outer surface of the guide protrusion contacts the outer surface of the outer wall surface of the channel. However, the fabric tends to move more outwardly and the guide protrusion is pushed outwardly and led to go away from the channel whereby the inner side of the guide protrusion is raised and the fabric bends by being pushed to the guide protrusion. When the fabric leaves from the inner roller, the bending is relieved. This bending movement is repeated and thereby the fabric is cut near the inner surface of the guide protrusion.

When fastening of the guide protrusion to the fabric is loosened and free space is provided for allowing small movement of the guide protrusion in the occasion the fabric is pushed to the guide protrusion, the bending of the fabric is moderated to some extent; however the cutting cannot be prevented. In addition, loose fastening of the guide protrusion decreases the guide performance; thereby the tendency of going away from the inner roller channel is disadvantageously increased. The protrusion may be provided at one end of the width direction or may be provided at both ends. Of course, the guide protrusion may be guided in contact with the end surface of the inner roller. In such a case, the guide protrusions are conveniently at both ends of the width direction of the fabric. When the fabric is spread and set, the guide protrusions are not directly spread and set on to the inner roller and the direct tension is not applied. The tension in the guide protrusion is smaller than in the fabric. Thus, the guide protrusion therefore bends to the center axis direction of the inner roller at the part of the fabric contacting to the inner roller. Hence, the fabric bends near the inner surface of the guide protrusion; when the fabric is left from the inner roller, the bending is moderated to mild bending. When this bending is repeated continuously, the fabric near the guide protrusion is abraded at the shoulder part of the inner roller by the bending of the guide protrusion to the direction of center axis of the inner roller as mentioned above, and the fabric is cut near the inner surface of the guide protrusion. In addition, when an inner roller having a deeper channel than the size of the guide protrusion, similar cutting occurs.

The present invention is to provide a fabric that has good guide performance and strong resistance to cutting thereby overcoming the defects mentioned above and to provide a process for densifying paper materials such as waste papers using this fabric.

SUMMARY OF THE INVENTION

The present invention relates to an endless multilayer fabric for densifying paper materials comprising: an endless fabric formed from multiple fabric woven by using at least three layers of weft consisting of a plastic monofilament and using warp consisting of a plastic monofilament. A bending resistant part of 30 through 50 mm width is formed by filling not less than 85% of the space of the fabric with a thermoplastic resin arranged at one end at least of trimming parts in the width direction of the endless fabric. A guide protrusion is formed by a thermoplastic resin integrally bonded by fusion into one body with the thermoplastic resin filled in the running surface of the bending resistant part. An auxiliary weft can be placed between the wefts in the bottom layer. Further, at least three layers of the weft consisting of a plastic monofilament can be a nylon monofilament. The weft in the top layer of the at least three layers of weft consisting of a plastic monofilament can be a nylon monofilament. The wefts in the highest and in the bottom layers of the at least three layers of weft consisting of a plastic monofilament can be nylon monofilaments. The weft in the top layer of the at least three layers of weft consisting of a plastic monofilament and the auxiliary weft in the bottom layer can also be nylon monofilaments. The resin layer of the filled thermoplastic resin in the bending resistant part can be a layer that does not protrude into the running surface of the endless fabric. Further, the guide protrusion can be a protrusion that is formed by using the same thermoplastic resin as the thermoplastic resin filled in the bending resistant part. The thermoplastic resin can be polyurethane resin.

A process for producing an endless fabric for densifying paper materials can be such that a resin sheet of a thermoplastic resin in the width of preferably 30 through 50 mm and in the thickness of preferably 1 through 1.5 mm is superimposed on at least one end of the trimming parts in the width direction of an endless fabric which is formed by multiple fabric woven by using at least three layers of a plastic monofilament and using warp consisting of a plastic monofilament, and adhered under heat and pressure. As a result, not less than 85% of the space of the fabric can be filled with the thermoplastic resin and a bending resistant part of preferably 30 through 50 mm width can be formed. Subsequently a protrusion formed on the running surface of said bending resistant part using the same thermoplastic resin is arranged by fusion integrally with the bending resistant part. In the process, a resin sheet of a thermoplastic resin in the width of preferably 30 through 50 mm and in the thickness of preferably 1 through 1.5 mm is superimposed on at least one end of the trimming parts on the surface opposite to the running surface, and adhered under heat and pressure.

The fabric used in the present invention is a fabric of preferably 45% through 70% porosity and preferably 0.5 mm through 1.2 mm thickness woven by using a polyethylene terephthalate monofilament as the warp and using a polyethylene terephthalate monofilament and/or polyamide monofilament as the weft.

PREFERRED EMBODIMENTS OF THE INVENTION

Figure 1:
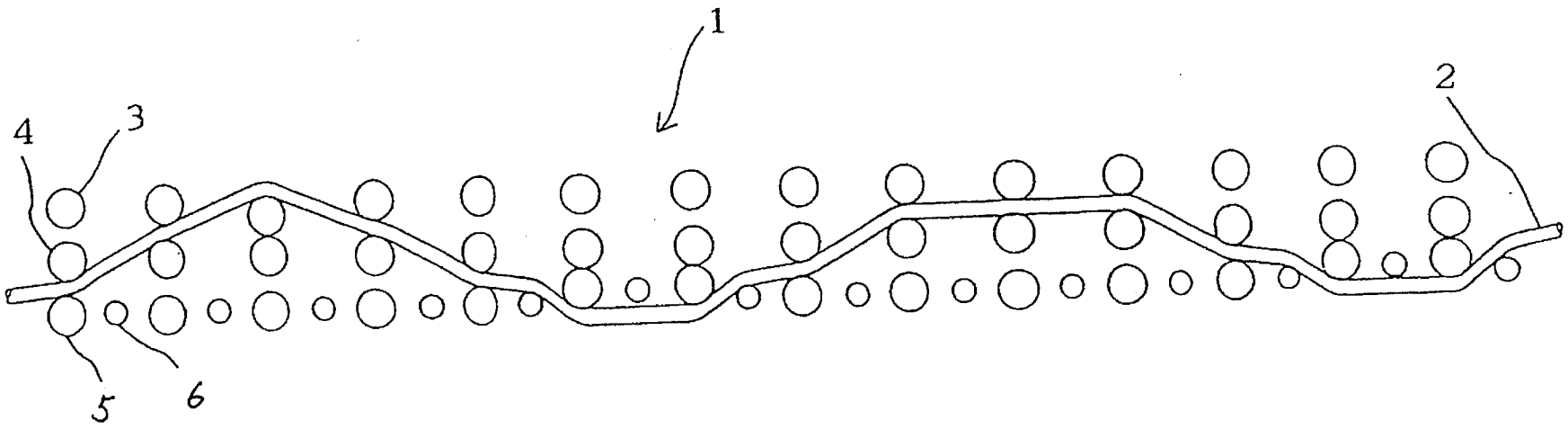
FIG. 1 shows a vertical cross sectional view showing a fabric used in an embodiment of the present invention.

In the present invention, a bending resistant part of thermoplastic resin having the width of preferably 30 through 50 mm is placed at the portion where a guide roll is located at the end part of the width direction of the fabric, and a guide protrusion is fastened to the bending resistant part by fusion. This fusion provides good guiding characteristic since the fabric is firmly bound.

When a thermoplastic resin is overlapped along the side edges in the width direction of the fabric and fused under heat and pressure, the thermoplastic resin penetrates into the fabric structure and combines uniformly with the fabric; and thereby a trimming part or trim edge that can hardly bend is formed as the bending resistant part of the fabric belt edge. The width of the bending resistant part is preferably 30 mm through 50 mm. The width of less than 30 mm may make bending easier and is less preferable. The. width of more than 50 mm will tend not to increase the desired effect.

The thermoplastic resin used in the present invention may be nylon, polyester resin, or polyvinyl chloride resin; however polyurethane resin is most preferable.

Hereunder, the case wherein polyester resin is used is explained in more details.

The amount of the polyurethane to be filled in the bending resistant part is preferably not less than 85% of the fabric space located n the edge area. The amount less than 85% tends not to result in enough bending resistant effect and satisfactory fusion to the guide protrusion. Since the guide protrusion member is fused together with the bending resistant part, the most preferable material with which to form the protrusion is what is used to form the sheet; e.g. the same polyurethane as the polyurethane sheet. The shape of the protrusion may be any suitable one such as of rectangular, circular, or triangular cross section; however, trapezoid protrusion is preferable since the fusion area is large.

Polyurethane resin is used in fabrication of the protrusion body and trimming edge because the wear resistance is excellent, the bond formed is good, and the flexibility is sufficient so that the turning at the inner roll is excellent.

The protrusion may be a continuous bar or formed with discontinuous several bars; however, discontinuous bars improve the turning at the inner roll.

An important characteristic of the present invention is the endless fabric structure. Provision of the bending resistant part in the trimming edge part of the endless fabric makes the guide protrusion body installed here stabilized and eliminates the cutting of fabric near the guide protrusion.

However, there still remains a problem of the fabric cutting near the inner end part of the bending resistant part. While various studies have been made to solve this problem, enlargement of the bending resistant part should be avoided since the fabric area for densifying is reduced. When greater flexibility is given to the bending resistant part by reducing the resin amount, the fabric is cut by bending near the guide protrusion body. Change of the resin to be applied has not improved the situation. The structure therefore has been improved noting the fabric structure.

For improving wear resistance, the endless fabric is made of weft abrasion type for the purpose of preventing the cutting of the warp. Observation of the cutting near the bending resistant part of endless fabrics for densifying paper materials has made it clear that the weft has been bent repeatedly and cut with fibrillation. Hence, there has been no effect by preventing abrasion of the weft. Even though two sheets of fabric have been laid together, respective fabrics have been cut almost simultaneously. In addition, there has been another problem, that is, the binding yarn binding both layer fabrics has been cut and the fabrics have separated.

A feature of the present invention is to make the fabric structure of not less than three layers of weft with the recognition that the fibrillation of the weft should be prevented by way of improving the bending resistance in the weft direction of the fabric. While the useful life is extended with multilayer arrangement of the warp and weft, the effect is not so much compared with the case where the warp is monolayer. From these experimental results, multilayer arrangements of the weft has been found effective. The auxiliary weft prevents the paper materials from leaking by making the lower layer fabric fine mesh. The wefts are placed at least in three layers; two layers do not tend to bring enough effects. When the extent of bending is large, it is preferable to use polyamide monofilament, which hardly fibrillates, in the top layer and/or bottom layer.

In an embodiment of the endless fabric of the present invention, a polyurethane resin sheet of 1 mm through 1.5 mm thickness is overlapped on the trimming part at the edge of the width direction of the fabric and fused under heat and pressure. In that process, the resin is allowed to penetrate sufficiently into the inner part of the fabric nearly up to the opposite surface. Then, a protrusion member molded from similar polyurethane resin is fused under heat and pressure to the surface opposite to the resin sheet application. In this way, both polyurethane resins are integrally fused together to make the product.

The endless multilayer fabric for densifying paper materials according to the present invention continuously removes ink particles, ash content, and fine fibers that do not form paper from aqueous slurries of waste paper materials by the nip pressure between the inner roll and the fabric and by centrifugal force by high speed revolution.

An embodiment of the present invention as explained referring the drawings.

FIG. 1 is a vertical cross sectional view of a fabric used in the embodiment of the present invention. Reference numeral 1 is a one-warp and three-weft fabric woven with a warp 2, upper layer wefts 3, center layer wefts 4, lower layer wefts 6 and auxiliary wefts 6 placed between lower layer wefts 5.

Figure 2:
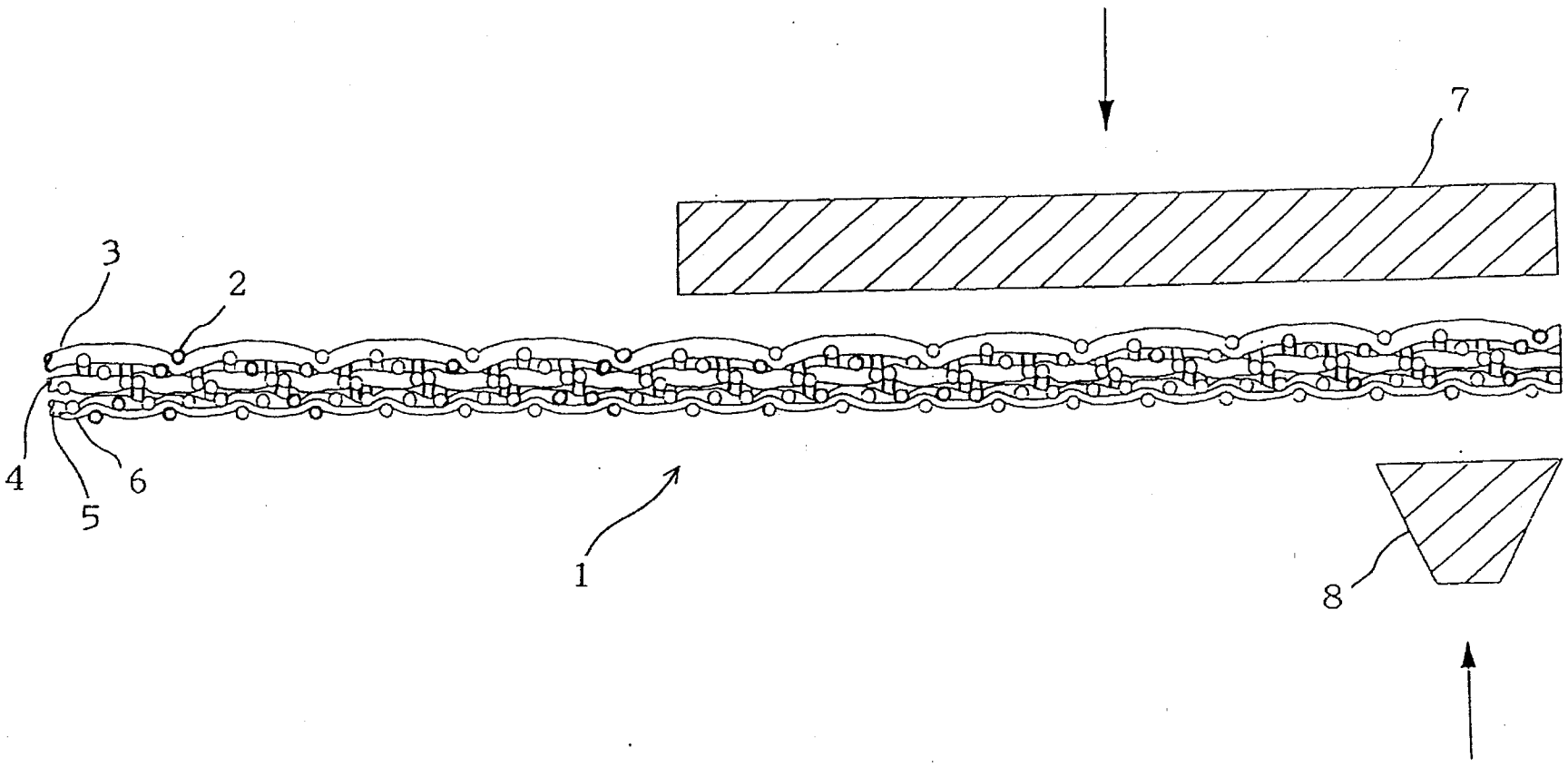
FIG. 2 shows a partial cross sectional view showing the condition before a bending resistant part and a guide protrusion are arranged.

FIG. 2 is a cross sectional view showing arrangement of a bending resistant part at the edge of the fabric and a guide protrusion at the trimming part edge of the fabric in the width direction. Reference numeral 1 is a fabric woven with warps 2, an upper layer weft 3, a center layer weft 4, a lower layer weft 5 and an auxiliary weft 6. Polyurethane resin sheet 7 is overlapped on one surface of the end of the width direction, and protrusion 8 of a trapezoid cross section is fused on the opposite side.

Figure 3:
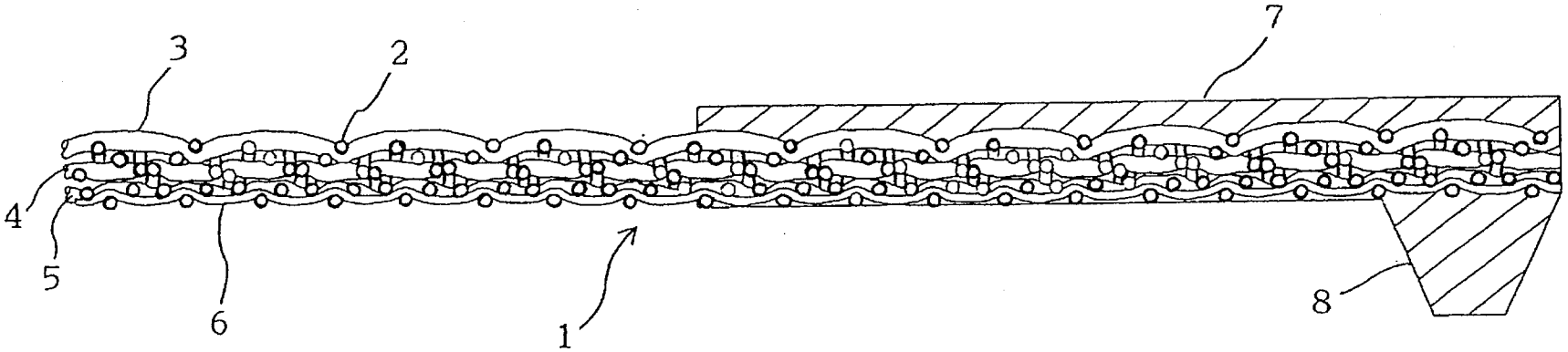
FIG. 3 shows a partial cross sectional view showing an integral combination of a bending resistant part and a guide protrusion with a fabric.

FIG. 3 is a cross sectional view of the fabric edge provided with a guide protrusion. The polyurethane resin sheet fused to the fabric under heat and pressure is shown to penetrate into the fabric structure up to near the opposite surface. The bending resistant part is thus formed. Moreover, the guide protrusion member is also fused under heat and pressure, partly penetrating into the fabric structure and being fused integrally with the bending resistant part. The trimming edge part of the fabric is thus made into a construction sealed with the polyurethane resin. The fabric therefore does not bend even near the inner side surface of the guide protrusion.

In addition, since the weft is positioned in three layers against bending near the bending resistant part, the bending resistance is so high that fibrillation and cutting do not occur.

Figure 4:
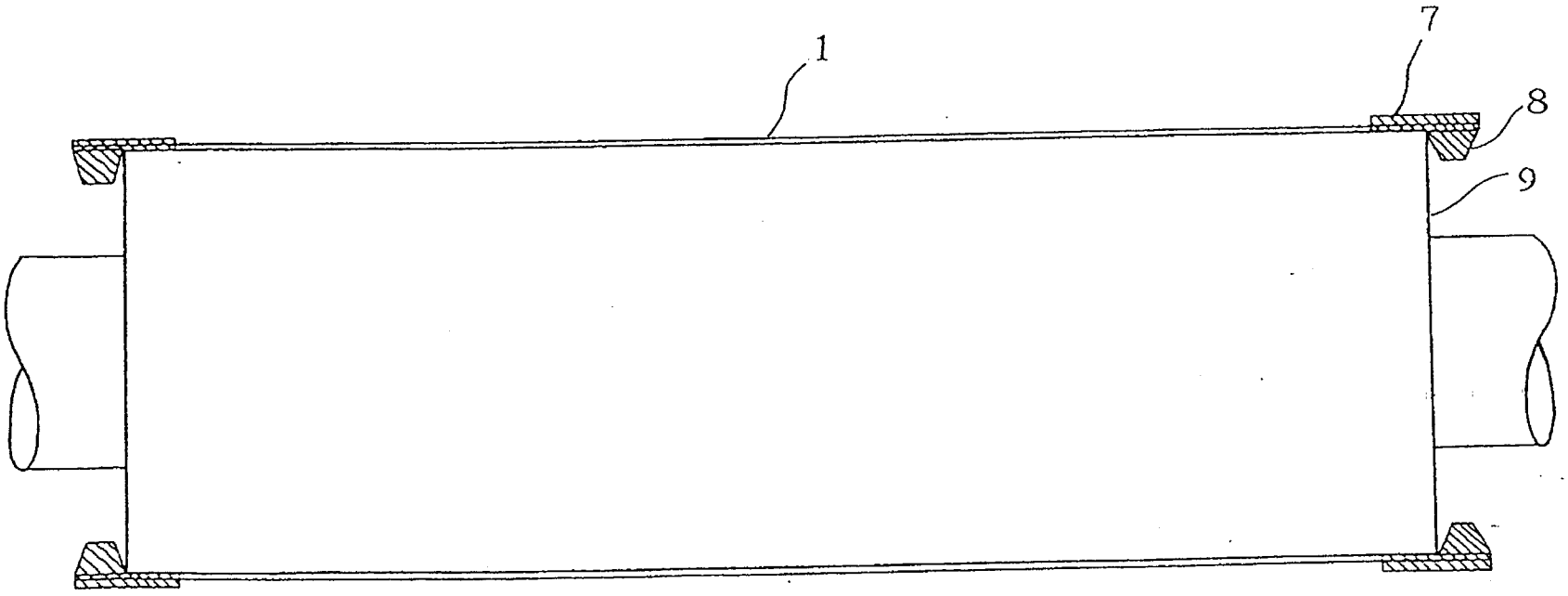
FIG. 4 shows a drawing illustrating a fabric according to the present invention spread and set on a roll.

FIG. 4 shows that the guide protrusion is in contact with the end of the inner roll showing cross section of the fabric of the present invention spread and set on inner roll 9. While the protrusion is provided at the trimming parts of both fabric edges in this example, the guide does not fall from the inner roll even if a protrusion is provided only on one trimming side since the increasing width of oblique movement is prevented.

Figure 5:
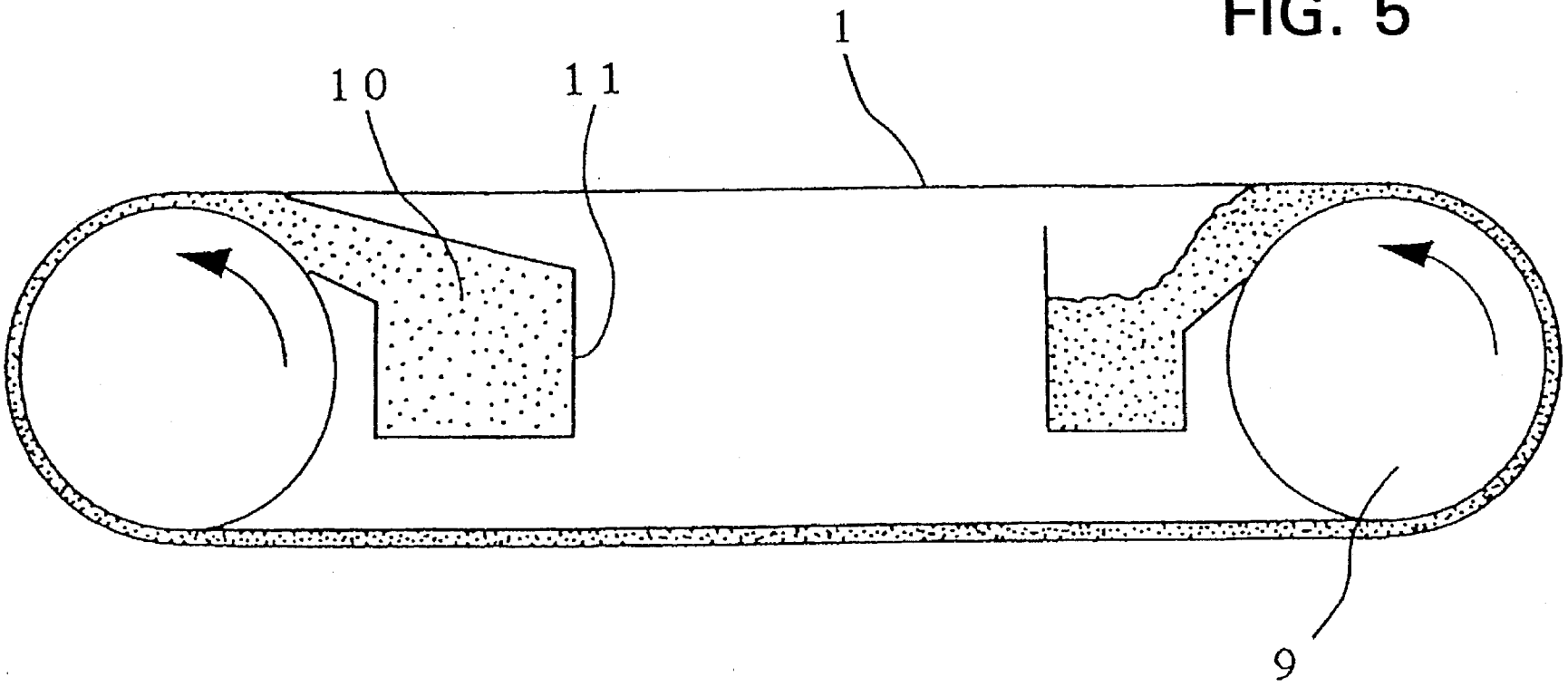
FIG. 5 shows a schematic drawing illustrating a step of pulp densification.

FIG. 5 illustrates a densifying device that densifies paper materials derived from waste papers using the fabric of the present invention. Paper material 10 is compressed between the inner roll and the fabric, subjected to centrifugal dehydration at the returning part, and collected.

Figure 6:
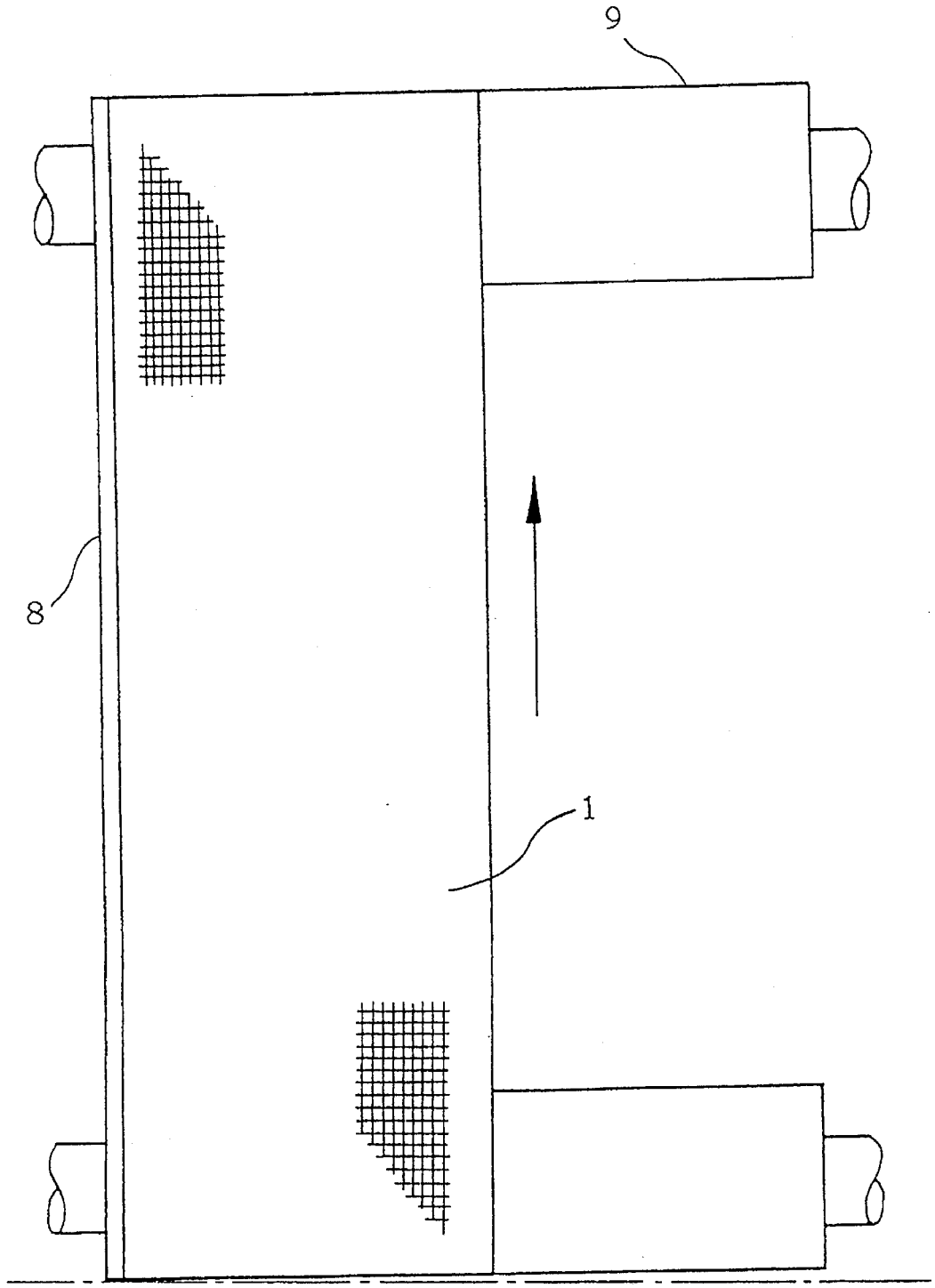
FIG. 6 shows a schematic drawing illustrating a method of comparative test.

FIG. 6 illustrates the apparatus that was used for the comparative tests. Two inner rolls are positioned as making circumferences of both left and right ends of the fabric varied so that the fabric moves obliquely.

Comparative Tests

Table 1 shows fabrics that were used in Working Example and Comparative Examples 1 and 2.

The same fabric was used for Comparative Example.

TABLE 1

| | Working Example | Comparative Example 1 | Comparative Example 2 |
|---|---|---|---|
| Upper Layer Warp | | | |
| Material | PET | PET | PET |
| Fiber Diameter | 0.17 | 0.30 | 0.30 |
| Number (Number/Inch) | 155 | 32 | 32 |
| Lower Layer Warp | | | |
| Material | | PET | PET |
| Fiber Diameter | | 0.20 | 0.20 |
| Number (Number/Inch) | | 64 | 64 |
| Upper Layer Weft | | | |
| Material | PA | PET | PET |
| Fiber Diameter | 0.30 | 0.35 | 0.35 |
| Number (Number/Inch) | 40 | 32 | 32 |
| Center Layer Weft | | | |
| Material | PET | | |
| Fiber Diameter | 0.25 | | |
| Number (Number/Inch) | 40 | | |
| Lower Layer Weft | | | |
| Material | PET | PET | PET |
| Fiber Diameter | 0.20 | 0.20 | 0.20 |
| Number (Number/Inch) | 40 | 64 | 64 |
| Auxiliary Weft | | | |
| Material | PA | | |
| Fiber Diameter | 0.13 | | |
| Number (Number/Inch) | 40 | | |

TABLE 1-continued

| | Working Example | Comparative Example 1 | Comparative Example 2 |
|---|---|---|---|
| Binding Yarn | | | |
| Material | | PET | PET |
| Fiber Diameter | | 0.15 | 0.15 |
| Number (Number/Inch) | | 16 | 16 |

Working Example

The working example shown in Table 1 is an endless fabric shown in FIG. 3 using a one-warp and three-weft fabric of 1.05 mm thickness. A polyurethane resin sheet of 0.082 g/cm$^2$ and 1 mm thickness is thermally fused on the trimming edge to provide a part resistant to bending; thereon a guide protrusion is thermally fused.

Comparative Example 1

The Comparative Example 1 shown in Table 1 is an endless fabric described in Japanese Laid-Open Patent No. 2-14090/1990 using an upper and lower two-layered fabric of 1.10 mm thickness consisting of two sheets of upper and lower fabrics combined with the binding yarn. A guide protrusion formed with a polyurethane resin is sewn into the trimming part with the thread.

Comparative Example 2

The Comparative Example 2 shown in Table 1 is an endless fabric described in Japanese Laid-Open Patent No. 4-36182/1992 using the same fabric as used in the Comparative Example 1. The same bending resistant part as in the Working Example is provided; thereon a guide protrusion is thermally fused.

Test Procedure

The apparatus shown in FIG. 6 was used. That is, the fabric was spread and set on two rolls that were positioned as making both left and right circumferences varied as predetermined for moving the fabric obliquely, and the fabric was rotated at 600 m/min. The results are shown in Table 2.

TABLE 2

| Example | Period of Time |
|---|---|
| Working Example | No change within 100 hours |
| Comparative Example 1 | Cut near the inner surface of the protrusion in 43 hours |
| Comparative Example 2 | Cut near the bending resistance part in 87 hours |

As apparent from Table 2, the fabric of the present invention is resistant to a long term use without cutting near the bending resistant to part of the trimming part.

Further variation and modification of the foregoing will be apparent to those skilled in the art and are intended to be encompassed by the claims appended hereto.

Japanese priority application No. 6-321789 is relied on and incorporated herein by reference.

What is claimed is:

1. An endless multilayer fabric for densifying paper materials comprising: an endless fabric formed of multiple fabric woven from at least three layers of weft consisting of a plastic monofilament and warp consisting of a plastic monofilament; a bending resistant edge part of 30 through 50 mm width formed by filling not less than 85% of the space of the fabric at the edge with a thermoplastic resin arranged at least along one end edge of the trimming portion in the width direction of the endless fabric; and a guide protrusion member formed of a thermoplastic resin integrally bonded by fusion into one body with the thermoplastic resin filled in the running surface of the bending resistant part.

2. The endless multilayer fabric for densifying paper materials according to claim 1 wherein an auxiliary weft is placed between the wefts in the bottom layer.

3. The endless multilayer fabric for densifying paper materials according to claim 1 wherein the at least three layers of weft consists of a nylon monofilament.

4. The endless multilayer fabric for densifying paper materials according to claim 1 wherein the weft in the top layer of the at least three layers of weft consists of a nylon monofilament.

5. The endless multilayer fabric for densifying paper materials according to claim 1 wherein the weft in the highest layer and in the bottom layer of the at least three layers of weft consist of nylon monofilaments.

6. The endless multilayer fabric for densifying paper materials according to claim 2 wherein the weft in the top layer of the at least three layers of weft and the auxiliary weft in the bottom layer are nylon monofilaments.

7. The endless multilayer fabric for densifying paper materials according to claim 1 wherein the resin layer of the filled thermoplastic resin in the bending resistant part is a layer that does not protrude into the running surface of the endless fabric.

8. The endless multilayer fabric for densifying paper materials according to claim 1 wherein the guide protrusion is a protrusion that is formed by using the same thermoplastic resin as the thermoplastic resin filled in the bending resistant part.

9. The endless multilayer fabric for densifying paper materials according to claim 1 wherein the thermoplastic resin is polyurethane resin.

10. A process for producing an endless fabric for densifying paper materials comprising: superimposing a resin sheet of a thermoplastic resin in the width of 30 through 50 mm and in the thickness of 1 through 1.5 mm is superimposed on at least one end of trimming parts in the width direction of an endless fabric which is formed by multiple fabric woven from at least three layers of a plastic monofilament and warp consisting of a plastic monofilament, and adhered under heat and pressure, whereby not less than 85% of the space of the fabric at the edge is filled with thermoplastic resin and a bending resistant part of 30 through 50 mm width is formed; and subsequently forming a protrusion member on the running surface of said bending resistant part using the same thermoplastic resin arranged by fusion in integration with the bending resistant part.

11. The process for producing an endless fabric for densifying paper materials according to claim 10 wherein said resin sheet of a thermoplastic resin is superimposed on the surface opposite to the running surface.

* * * * *